US006098548A

United States Patent [19]

Rink et al.

[11] Patent Number: 6,098,548

[45] **Date of Patent: *Aug. 8, 2000**

[54] NON-PYROTECHNIC INITIATOR

[75] Inventors: Karl K. Rink, Liberty; Walter A. Moore, Ogden; David J. Green, Brigham City, all of Utah

[73] Assignee: Autoliv ASP, Inc., Ogden, Utah

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/810,790

[22] Filed: Mar. 5, 1997

[51] Int. Cl.[7] ..... C06D 5/00; F42B 3/12; F42B 3/14

[52] U.S. Cl. ..... 102/531; 102/202.7; 102/202.8; 102/202.14; 280/737; 280/741

[58] Field of Search ..... 280/736, 737, 280/741, 742; 102/202.5, 202.7, 202.8, 202.9, 202.14, 202, 315, 530, 325, 327, 328, 472, 531; 89/8

[56] References Cited

U.S. PATENT DOCUMENTS

| | | | |
|---|---|---|---|
| H927 | 6/1991 | Miller | 102/440 |
| 2,426,269 | 8/1947 | Hopkins | 102/202 |
| 2,899,864 | 8/1959 | Bloxsom, Jr. | 89/8 |
| 3,695,179 | 10/1972 | Rainone et al. . | |
| 3,788,669 | 1/1974 | Usui et al. . | |
| 3,822,895 | 7/1974 | Ochiai . | |
| 4,006,687 | 2/1977 | Ridgeway | 102/530 |
| 5,010,804 | 4/1991 | Lee | 89/8 |
| 5,060,973 | 10/1991 | Giovanetti | 280/736 |
| 5,225,643 | 7/1993 | Marchant | 200/834 |
| 5,310,214 | 5/1994 | Cuevas | 280/729 |
| 5,344,186 | 9/1994 | Bergerson et al. | 280/741 |
| 5,348,344 | 9/1994 | Blumenthal et al. | 280/737 |
| 5,378,018 | 1/1995 | Ketterer et al. | 280/737 |
| 5,406,889 | 4/1995 | Letendre et al. | 102/201 |
| 5,419,257 | 5/1995 | Leichter et al. | 102/315 |
| 5,429,387 | 7/1995 | Clark et al. | 280/737 |

(List continued on next page.)

FOREIGN PATENT DOCUMENTS

| | | | |
|---|---|---|---|
| 405045098 | 2/1993 | Japan | 102/472 |

OTHER PUBLICATIONS

Definition for "combustible"; Webster's New Riverside University Dictionary, 1994.

Frank–Kamenetski, D.A., *Diffusion and Heat Exchange in Chemical Kinetics*, Princeton University Press, Princeton, N.J. pp. 202–235, 1955.

Griffiths, J.F. & Scott, S.K., *Thermokinetic Interactions: Fundamentals of Spontaneous Ignition and Cool Flames*, Progress in Energy and Combustion Science, vol. 13, pp. 161–197, 1987.

McQuaid, R.W. et al., *Flammability and Sensitivity of Materials in Oxygen–Enriched Atmospheres*, ASTM Special Technical Publication 812, edited by B.L. Werley, pp. 43–55, 1983.

Penner, S.S. et al., *Explosions Detonations, Flammability and Ignition*, Advisory Group for Aeronautical Research and Development, Pergamon, New York, pp. 192–217, 1959.

Zabetakis, M.G., *Flammability Characteristics of Combustible Gases and Vapors*, U.S. Bureau of Mines Bulletin 627, pp. 1–14, 1965.

*Primary Examiner*—Harold J. Tudor
*Attorney, Agent, or Firm*—Salley J. Brown

[57] ABSTRACT

An initiator suitable for use with airbag passive restraint systems and which does not use pyrotechnic materials is disclosed. The initiator provides an electrically actuated igniter which ignites an adjacently stored non-pyrotechnic fluid combustible material which may comprise a mixture of a fluid fuel and a fluid oxidizer, a fluid monopropellant or a fluid exothermically decomposable material. A subassembly of the non-pyrotechnic initiator with a fuel containment chamber and inflators which use the non-pyrotechnic initiator are also disclosed.

18 Claims, 3 Drawing Sheets

U.S. PATENT DOCUMENTS

| | | | |
|---|---|---|---|
| 5,460,671 | 10/1995 | Khanadadia | 149/109.6 |
| 5,470,104 | 11/1995 | Smith et al. | 280/737 |
| 5,487,561 | 1/1996 | Mandzy et al. | 280/741 |
| 5,494,312 | 2/1996 | Rink et al. | 280/737 |
| 5,496,062 | 3/1996 | Rink et al. | 280/737 |
| 5,531,473 | 7/1996 | Rink et al. | 280/737 |
| 5,571,988 | 11/1996 | Hagel et al. | 149/1 |
| 5,577,769 | 11/1996 | Di Giacomo et al. | 280/736 |
| 5,580,086 | 12/1996 | McAlister | 280/737 |
| 5,607,181 | 3/1997 | Richardson et al. | 280/737 |
| 5,630,619 | 5/1997 | Buchanan et al. | 280/741 |
| 5,669,631 | 9/1997 | Johnson et al. | 280/741 |
| 5,686,691 | 11/1997 | Hamilton et al. | 102/202.5 |
| 5,713,595 | 2/1998 | Mooney et al. | 280/736 |
| 5,713,597 | 2/1998 | Bailey | 280/741 |
| 5,736,668 | 4/1998 | Fogle, Jr. et al. | 102/202.7 |
| 5,746,445 | 5/1998 | Johnson et al. | 280/741 |
| 5,778,266 | 7/1998 | Moore et al. | 280/737 |
| 5,779,266 | 7/1998 | Moore et al. | 280/737 |
| 5,779,289 | 7/1998 | Moore et al. | 280/741 |
| 5,786,543 | 7/1998 | Staudhammer et al. | 102/288 |
| 5,803,492 | 9/1998 | Rink et al. | 280/737 |
| 5,803,494 | 9/1998 | Headley | 280/741 |
| 5,836,610 | 11/1998 | Rink et al. | 280/736 |
| 5,857,698 | 1/1999 | Fuerst et al. | 280/737 |
| 5,857,699 | 1/1999 | Rink et al. | 280/737 |
| 5,879,025 | 3/1999 | Blumenthal | 280/741 |

NON-PYROTECHNIC INITIATOR

BACKGROUND OF THE INVENTION

This invention relates to an initiator which is used to initiate a heat and pressure producing chemical reaction in response to an electrical signal. The produced heat and pressure wave can then be used to initiate further chemical reactions. These chemical reactions produce sufficient heat and pressure to rapidly ignite adjacent materials, such as the gas generating materials used in inflators of vehicle passive restraint airbag systems.

The inflators used in vehicle airbag systems need to deliver sufficient gas to inflate the system's airbag, or cushion, in a very short time frame. They further need to provide safety and reliability both over the extensive temperature range in which modern vehicles are expected to operate, and over the extended lifetime, typically fifteen years, of a modern vehicle.

Inflators for airbag systems generally actuate upon receipt of an electrical signal from a crash sensor located elsewhere on the vehicle body. Such electrical signal is routed to an initiator, often an electrical squib, wherein it creates a hot spot or a spark sufficient to cause ignition of an adjacent relatively small amount of a solid pyrotechnic or explosive material. The ignition of such solid rapidly generates heat and/or a pressure wave which initiates a gas generating chemical reaction in an adjacent relatively large quantity of gas generating material. The reaction products from the igniter may operate to initiate reaction in the gas generant material directly or such products may initially ignite an intermediate igniter material and the mixed reaction products from such intermediate igniter material then be used to ignite the gas generant material.

The initiators normally used in airbag systems have relied on heat and/or pressure to ignite pyrotechnic materials which then ignite an adjacent heat and/or gas generating material. While these systems have performed adequately, special handling of the pyrotechnic material is required during manufacture of the device. Pyrotechnic materials are usually classified as a Class 1 (more specifically, Classes 1.1 and 1.3) material in Department of Transportation (DOT) Shipping Regulations. Special DOT approvals or permits are generally required for the shipment of Class 1 materials.

A number of different types of inflators have been developed for use in airbag systems. One type of inflator simply releases a compressed gas to inflate the cushion. This type requires a relatively large and strong container for storing the compressed gas. As a result, these inflators are relatively large and relatively heavy, both of which are disadvantages to vehicle manufacturers who generally seek to minimize the size and weight of the components used in their vehicles.

A second type of inflator generates gas by the rapid combustion of solid pyrotechnic gas producing materials, such as metal azides. The combustion reaction is typically initiated by a pyrotechnic initiator.

A third type of inflator, referred to as a hybrid inflator, relies on the rapid combustion of solid materials, such as polyvinyl chloride-potassium perchlorate, to produce both gas and heat, which are then mixed with and heat a stored compressed gas. The heat added to the compressed gas raises its temperature causing its pressure and/or volume to increase. The combined gas produced from the combustion reaction and the heated compressed gas is then used to inflate the airbag.

A recently developed inflator is described in U.S. Pat. No. 5,470,104 to Bradley Smith and Karl Rink. This inflator uses the combustion of a fluid fuel with a fluid oxidizer to generate a heated gas which can be used either to directly inflate an airbag, or to heat a further compressed inert gas before using the combined gases to inflate the airbag. The fluid fuel and oxidizer typically is ignited by a pyrotechnic initiator.

Any of the inflators which use solid pyrotechnic gas generating materials, such as metal azides, will produce entrained glowing hot solid particulates in the product gases. In addition, any inflator using a pyrotechnic initiator, even those which use fluid fuels and oxidants as the gas generant, will produce some combustion by-products in the form of solid particulates (smoke). These hot particulates not only can cause serious burns to occupants of the vehicle, they can be a potential source of failure of the fabric or plastic film materials used to form the cushion. Airbag inflators which rely on pyrotechnic gas generating materials usually contain filters to remove the particulates from the product gas before such particulates can contact the cushion. The filters, however, are relatively bulky and heavy, undesireably adding to the system's size and weight.

Moreover, many of the prior art inflators are housed in structures manufactured from materials, such as aluminum, which are significantly weakened at temperatures which could be encountered in a vehicle or warehouse fire. In order to avoid the possibility of the structure becoming weak and disintegrating into pieces which then are propelled throughout the vicinity, these structures normally include a material which causes auto-ignition at a temperature below that at which the structural material is significantly weakened. The pyrotechnic materials normally used in initiators usually have, for a given composition, an intrinsic auto-ignition temperature. Thus, there is no opportunity to adjust, or tailor, the auto-ignition temperature without adjusting the pyrotechnic composition. However, adjusting or changing the pyrotechnic composition can significantly affect other properties of the pyrotechnic, such as burn rate, combustion temperature, shock and vibration sensitivity, electrostatic discharge sensitivity, and gas yield, to name a few. It has, therefore, generally been necessary to rely on a separate additional auto-ignition material to provide auto-ignition at the desired temperature in inflators which rely on pyrotechnic initiators. One recently developed technique of controlling the design and filling of the fuel of a fluid fueled inflator in a containment element is described in recently issued U.S. Pat. No. 5,494,312 to Karl K. Rink. This technique can provide for the containment element to rupture at a preselected temperature which then permits the fuel to mix with adjacently stored oxidant and autoignite.

Recently issued patents to Karl K. Rink et al., U.S. Pat. No. 5,496,062, and to Marcus T. Clark et al., U.S. Pat. No. 5,429,387, describe several versions of an apparatus used in a hybrid inflator, wherein the functions of a low pressure switch, squib and gas generator are combined in a single chamber which is deployed in a further chamber containing the pressurized inert gas of the hybrid inflator. The single chamber contains all, or at least the major portion, of the gas generating material required by the hybrid gas generator or inflator. Opposed diaphragms provided as part of the housing defining the single chamber react to the pressure inside and outside of the chamber to either close or open an electrical circuit, thereby providing an indication of whether or not the sensed pressures are within specification. Upon activation of the gas generator, the gas generating material within the single chamber is ignited by various disclosed devices including a bridgewire resistor, a squib (pyrotechnic) initiator and a hybrid squib. The gas generating material is a liquid fuel in U.S. Pat. No. 5,496,062 and either a solid material or a mixture of gases in U.S. Pat. No. 5,429,387. While this apparatus provides multiple functions, it has many components and is relatively large and complex to assemble. As its overall size is decreased, the assembly of its component parts of diminished size into a device which includes a reliable switch becomes increasingly difficult. Not only is its applicability limited to fluid fueled hybrid inflators, its complex assembly limits its practical application to those hybrid inflators which have relatively large fuel requirements. Accordingly its primary intended use is as an inflator in passenger side airbag systems, which systems typically require the storage of 6 to 8 cubic inches of gas generant. The apparatus may find some use in driver side airbag systems which typically require 2 to 4 cubic inches of gas generant storage volume. They do not presently appear to have reasonable applicability to the relatively small side impact airbag systems. In contrast the present initiator is relatively small, easy to assemble and has broad general applicability.

It is an object of the present invention to provide an initiator which does not rely on solid pyrotechnic materials and which can be used to initiate gas generation in most of the gas generating inflators used in airbag passive restraint systems. The inventive initiators can be used in other systems which require an elevated temperature and/or a pressure or shock wave to initiate a reaction. Their principal use, however, is presently contemplated to be in gas generators, or inflators, for rapidly providing a quantity of non-toxic particle free gas for inflating apparatus, such as the airbag cushions of vehicular passive restraint systems.

A further object of the present invention is to provide an initiator which in addition to its function in initiating reaction in the ignition train, also provides for auto-ignition to occur at preselected temperatures.

Another object is the provision of a gas generator which uses the non-pyrotechnic fueled initiator.

A still further object is the provision of an assembly containing both the inventive initiator and a separate fluid fuel chamber which can be then be assembled into a gas generator as a unit.

SUMMARY OF THE INVENTION

The inventive initiator uses an electrical spark, heated wire, semi-conductor bridge or other heat generating device to ignite a non-pyrotechnic fluid combustible material. The spark or heat generating device is connected to electrical leads which are adapted for electrical connection to an activating device, such as, in the case of an airbag passive restraint device, a crash sensor located elsewhere on the vehicle. The fluid combustible material can comprise a mixture of a fluid fuel and a fluid oxidizer, a liquid monopropellant or a liquid or gaseous material which dissociates in an exothermic reaction.

The invention also includes fluid fueled inflators for use with airbag passive restraint systems which incorporate the present initiator therein. A particularly advantageous embodiment involves an initiator containing an amount of fluid combustible material which provides for auto-ignition of the inflator at a selected auto-ignition temperature. A further aspect of the invention involves a subcombination wherein the inventive initiator is combined with a fluid fuel storage chamber.

Certain embodiments of this invention provide an inflator which, in addition to not containing a pyrotechnic material in its initiator, does not otherwise, as in its principal gas generant, contain materials which result in hot particulates in the product gases. Since such embodiments are free of solid pyrotechnics, the need to provide for filtration of the combustion products is avoided, or at least greatly diminished, resulting in reductions of inflator weight, manufacturing complexity, cost and visible particulate levels.

DETAILED DESCRIPTION OF THE INVENTION

Figure 1:
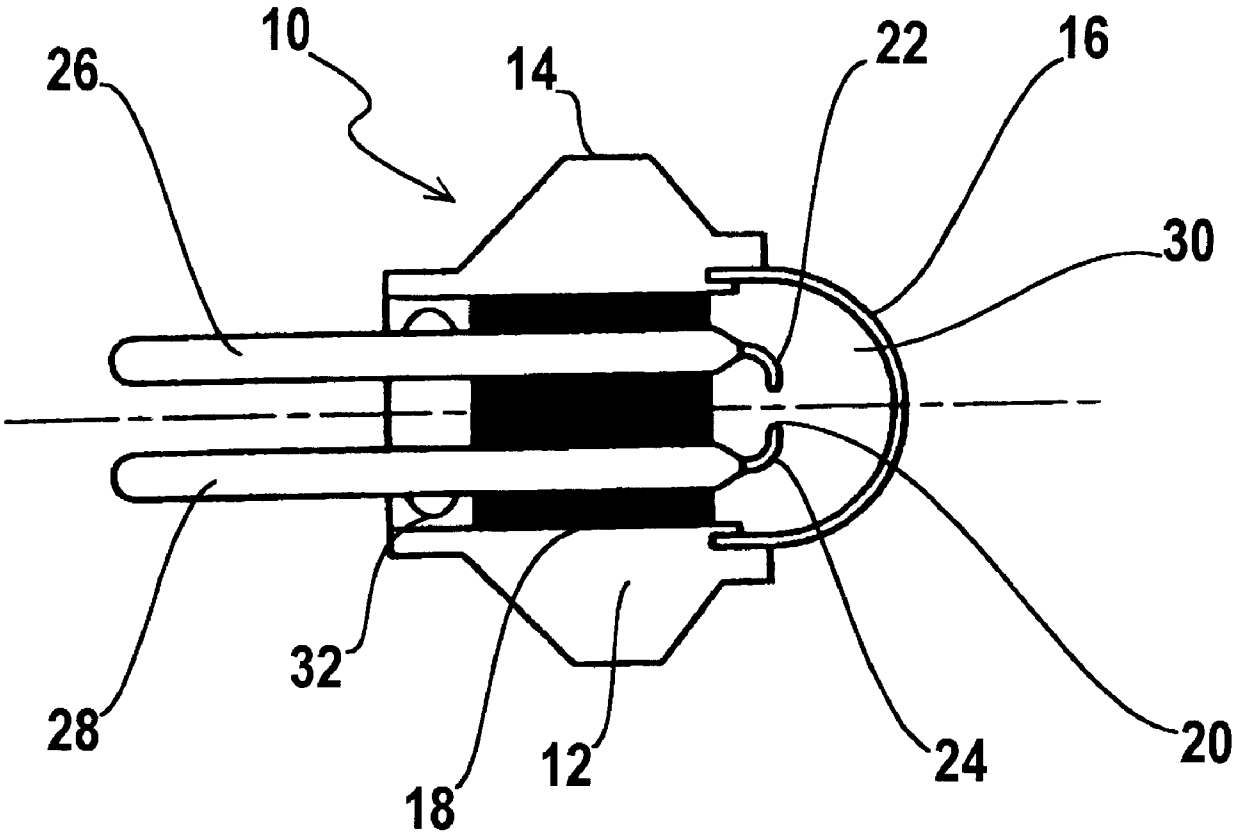
FIG. 1 illustrates a non-pyrotechnic initiator in accord with the present invention.

The initiator 10, as illustrated in FIG. 1, includes an initiator housing 12 comprising body 14, hemispherical shaped cap 16 and glass-to-metal seal 18. An igniter device, such as a spark generator 20, is provided between two electrical conductors 22, 24. The conductors are electrically connected to electrical leads 26, 28 which extend through the glass-to-metal seal 18 to the exterior of the housing where they are adapted to be electrically connected to an actuator (not shown), such as a crash sensor. The housing 12 defines a fluid tight chamber 30 surrounding the spark generator 20. The body 14 and cap 16 are formed from relatively rigid materials whereby the volume of the fluid tight chamber is not significantly affected by external pressure variations. A fluid non-pyrotechnic combustible material is stored in the fluid-tight chamber 30 (also referred to as the charge holder) in direct proximity to the spark generator 20. The initiator can include ferrite beads 32 on the electrical leads 26, 28, if desired or required to provide an initiator resistant to unplanned or unwanted operation when under the influence of spurious electromagnetic interference resulting from background electromagnetic wave transmissions, etc.

The igniter device can be selected from various known spark gap, bridgewire and semiconductor bridge devices as are often used in squibs. The spark gap transducers, or spark generators, produce an electrical spark in the combustible material which initiates the combustion reaction therein. The bridgetype transducers produce a hot spot in an electrically resistive bridge provided between two conductors. The resistive bridge can be formed from a wire, a semiconductor material or a thin film. The hot spot produced by such bridgetype transducers is sufficiently hot to initiate the combustion reaction in the fluid combustible material.

Preferably, the components of the housing are designed to open upon ignition without disintegrating and forming a large number of particles which would then need to be filtered from the product gases before they contact the fabric of the airbag cushion. Accordingly, the body 14 and cap 16 of the housing can be fabricated from non-frangible metals or plastics. Further, these components can be provided with areas of diminished strength, such as areas of diminished thickness or scored creases, which encourage the housing to open at locations which are preselected to avoid the formation of free, or unattached, particles.

The fluid non-pyrotechnic combustible material may consist of various mixtures of fluid fuels with fluid oxidizers, liquid monopropellants, and liquid or gaseous materials which dissociate in a rapid exothermic reaction. Additionally, the non-pyrotechnic combustible material may contain a minor amount of other materials such as helium, an inert gas which is often provided to facilitate leak testing. It should be understood, that in the context of the present invention, a fluid is defined as a material which continuously deforms under an applied shear stress. Sometimes the distinction between solids and fluids is not sharply defined. In the context of the present invention, the term fluid is intended to include materials or mixtures of materials, which, when subjected to a shear stress, will resist deformation for a relatively limited period of time before flowing as a liquid, such as some suspensions and colloids. Generally, liquid, or liquified, non-pyrotechnic combustible materials are preferred since they (a) typically provide a greater density of material than do gases, and (b) are easier to load and seal in the chamber 30 than are compressed gases.

The term "pyrotechnic" is generally used in the art to refer to generally solid-phase explosive materials in which a fuel and an oxidant are inherently combined within a given composition, through either chemical or physical bonding. The term "non-pyrotechnic" is used herein to exclude such solid phase explosive materials comprising a chemically or physically bound fuel and oxidant.

The fluid fuels to be used with fluid oxidants can be selected from various gaseous and liquid materials, while the fluid oxidizers can be selected from gaseous or liquid materials. These fuels include hydrogen, hydrocarbons and hydrocarbon derived fuels, such as gasoline, kerosene, $C_1$–$C_8$ paraffins, ethers, esters and alcohols. Ethyl and propyl alcohol are particularly advantageous liquid fuels. Butane is an advantageous fuel which can be stored in the liquid phase or as a mixture of liquid and gas phases. Mixtures of the various fuels can also be used.

The fluid oxidants to be provided with the fluid fuels can comprise oxygen or nitrous oxide ($N_2O$), either in pure form or diluted with diluents such as nitrogen, carbon dioxide or one or more of the noble gases including helium, argon and xenon. Of course, air, air diluted with a diluent, or oxygen enhanced air are suitable fluid oxidants.

When the combustible material comprises a mixture of fluid fuel and fluid oxidant, the relative quantities of these components may be adjusted to provide a desired auto-ignition temperature, whereby the initiator will also function as an auto-ignition source for the inflator. The auto-ignition temperature of a fuel/oxidant mixture is controlled by many factors. Some of these factors relate to the inherent chemical nature of the constituents, while others relate to the physical conditions affecting the mixture. Primary chemical factors are the type and relative concentrations of fuel and oxidant. The presence of contaminants and potential catalysts can also have an important affect on autoignition. Important physical factors include the pressure of the mixture, the modes of heat transfer to and from the mixture, the shape and condition of the containment vessel and the degree of mixing of the fuel and oxidant. A number of autoignition temperatures for various materials, under both flowing and static conditions have been reported in the literature. For instance, the autoignition temperature for many combustible gases, liquids and vapors in stationary mixtures has been presented by M. G. Zabetakis in U.S. Bureau of Mines Bulletin 627, *Flammability Characteristics of Combustible Gases and Vapors*, U.S. Department of the Interior, Bureau of Mines, 1965. In comparison to the conditions expected to be employed in the present igniter, most of the reported autoignition temperatures relate to relatively low pressure and/or low oxygen concentration conditions. An example of a high pressure autoignition study is reported by R. W. McQuaid et al. in *Flammability and Sensitivity of Materials in Oxygen-Enriched Atmospheres*, ASTM Special Technical Publication 812, edited by B. L. Werley, 1983. The results indicate (as theory would predict) that the autoignition temperature of a given fuel/oxidant mixture is greatly reduced by increases in pressure and oxygen concentration.

The auto-ignition temperature of materials, or mixtures of materials, can be determined by running a series of auto-ignition tests at various pressures and oxidant concentrations. Such tests can be conducted under either flowing or static conditions. One reasonably convenient and inexpensive technique involves filling a cleaned combustion chamber having an internal volume of about 6 cubic inches with the desired quantities of fuel and oxidant to result in the desired test pressure, and sealing the container. After checking for leaks, the combustion chamber is placed in an oven and the temperature raised until autoignition occurs. A thermocouple provided on the combustion chamber provides for essentially continuous monitoring and recording of the temperature. Upon reaching the auto-ignition temperature, the mixture combusts causing a rupture disc or other pressure relief device on the combustion chamber to open thereby releasing the pressure before the combustion chamber disintegrates. It is preferred that the oven be protected by placing the combustion chamber in a containment vessel which is capable of containing fragments of the chamber should it disintegrate during the test despite the presence of the pressure relief device. Auto-ignition is usually marked by termination of the temperature reading resulting from destruction of the thermocouple. Analysis of a series of auto-ignition temperatures at different oxidant concentrations and fuel/oxidant mixture pressures should provide a reasonable approximation of the combustible mixture fill conditions required to provide the desired auto-ignition temperature. The auto-ignition temperature of the combustible mixture should then be further checked/tested in prototypes of the intended igniter whereby the results will reflect any effects due to such factors as the shape or surface finish of the containment vessel. As an example, a mixture of pure ethyl alcohol as the fuel and a mixture of 60% oxygen, 25% argon and 15% helium, as the oxidant, provided at an equivalence ratio of 0.6 and at a pressure of 2000 psi in a 6.75 cubic inch combustion chamber will auto-ignite at a temperature of approximately 270° C.

When the initiator is to be used in an inflator having an aluminum housing, it is desirable to adjust the ratio of fuel to oxidant to provide an auto-ignition temperature of between 300° C. and 550° C.

Butane and nitrous oxide is a particularly advantageous fuel/oxidant mixture for use in the inventive initiator. This mixture burns rapidly, yet is stable at those temperatures to which the initiator would be subject under normal conditions. While both butane and nitrous oxide are normally gases, they are both relatively easy to liquify so that a liquid phase mixture of butane and nitrous oxide could be used during fabrication of the initiator. This is particularly useful in filling the mixture into the initiator. The liquified mixture can be frozen into a small pellet. The pellet can be loaded into a portion of the unassembled housing which could then be assembled and rapidly welded, by such as laser welding, to form a fluid tight chamber before the material in the pellet melts and vaporizes. In this regard, a gas/liquid mixture of 0.08 gram of nitrous oxide with 0.0048 gram of butane could be held in a 1.38 cc chamber at a pressure of approximately 660 psi (at room temperature) or it could be held in a 1.15 cc chamber at a pressure of approximately 850 psi.

The fluid non-pyrotechnic combustible material may also be a fluid monopropellant, such as mixtures of hydroxyl ammonium nitrate and triethyl ammonium nitrate (commonly referred to as HAN/TEAN) or mixtures of HAN/TEAN and water.

The fluid non-pyrotechnic combustible material may further be selected from fluid materials which dissociate (i.e. decompose) in a rapid exothermic reaction, such as compounds encompassed by the hydrazine family, as well as hydrazine-based materials with inert gas(es), acetylene-based materials, as well as acetylene-based materials with inert gas(es), certain organic peroxides, as well as peroxides with inert gas(es), and nitrous oxide ($N_2O$) and mixtures of nitrous oxide with inert gas(es).

Nitrous oxide ($N_2O$) is a preferred fluid combustible material which can, given proper conditions, exothermically dissociate. Nitrous oxide is normally considered a strong oxidizing material, but under proper circumstances can undergo an exothermic decomposition. It should be understood that the terms combustible material, combust, ignite, etc., as used in this application, are specifically intended to be inclusive of materials capable of exothermic dissociation, such as nitrous oxide, and the exothermic dissociation which they exhibit, even if such dissociation does not involve the classic combination of a fuel with an oxidizer which is often considered to be a characteristic of burning, combusting or igniting. Nitrous oxide can be stored in the liquid state at relatively low pressures (liquid begins to form at 5.1 MPa at 20° C.) and is stable at temperatures well above ambient temperatures (in excess of 200° C.). Airbag inflators are normally designed to experience temperatures between −40° C. and 130° C. Nitrous oxide does not undergo exothermic dissociation until temperatures of roughly 565° C. are approached. Its exothermic dissociation can be initiated by a spark discharge device or by providing a localized hot spot such as is produced in bridgewire igniters. Nitrous oxide and its principal dissociation products, $N_2$ and $O_2$, are non-toxic. The reliability of initiation of the dissociation reaction can be enhanced by providing a sensitizing material in mixture with the nitrous oxide. The sensitizing material typically contains hydrogen, and can be provided in an amount which is below the flammability limits of the resulting mixture. Suitable hydrogen containing materials include molecular hydrogen, hydrocarbons and hydrocarbon derivatives. Molecular hydrogen ($H_2$), butane, or a hydrogen containing finely divided solid, such as ethyl cellulose, can be advantageously used as a nitrous oxide decomposition sensitizer. A finely divided solid sensitizer is particularly advantageous since it can be easily added to the mixture. It can be difficult to mix very small quantities of a gas into a mixture. During manufacture, the nitrous oxide can be installed in cup 16, or its equivalent, in a frozen state, and the cup then welded or otherwise attached to body 14 before the nitrous oxide heats sufficiently to develop pressure in the chamber 30. This procedure significantly simplifies the fabrication process by avoiding the problems associated with welding fuels and/or oxidizing materials under pressure. The generation of inflation gases in an inflator by the exothermic dissociation of materials such as nitrous oxide, is described in patent application Ser. No. 08/632,698, filed by Karl K. Rink on Apr. 15, 1996, now U.S. Pat. No. 5,669,629, the content of which is hereby incorporated by reference.

The initiator is not intended to provide sufficient combustible material to produce all of the product gas requirements of the inflator. It is only necessary that it function in an ignition train by providing an amount of combustible material which is sufficient to (1) provide reliable ignition upon receipt of the electrical activation signal and (2) produce sufficient ignition product to reliably ignite a significantly greater amount of a proximately deployed gas generating material. The initiator should contain an amount of combustible material which will produce a peak pressure of between 50 and 20,000 psia (between 0.34 and 137.9 MPa) when ignited in a 10 cubic centimeter closed bomb. Preferably, an amount of combustible material sufficient to produce a peak pressure of between 400 and 4000 psia (between 2.8 and 27.6 MPa) is provided. Most preferably, the amount of combustion material provided is sufficient to produce a peak pressure of between 800 and 2500 psia (between 5.5 and 17.2 MPa). optionally, an additional ignition assisting material, such as a mixture of boron and potassium nitrate, may be provided as a booster charge in the ignition train following the inventive initiator and before the main charge of gas generating material. The amount of fluid combustible material necessary to provide the required energy output can be stored in a charge holder, or chamber 30, having a volume of less than 25 cubic centimeters. Advantageously, the required fluid combustible material is stored in a charge holder having a storage volume of 0.25 to 10 cubic centimeters. It is most preferred that the storage volume of the charge holder be from 0.25 to 1.5 cubic centimeters.

While the initiator can be used to initiate a variety of heat or pressure sensitive chemical reactions in response to an electrical impulse, it is particularly useful for initiating reactions which provide heat and/or gas in inflators for airbag systems. Moreover, the use of the inventive initiator with the recently developed fluid fuel inflators for such systems is particularly advantageous. Usually, the only pyrotechnic material found in fluid fuel inflators are associated with the pyrotechnic initiators used therein. The use of the present initiator in such fluid fuel inflators eliminates the need for any special handling and shipping of the inflator because of the presence of pyrotechnic materials. Moreover, most embodiments of the present initiator provide a combusted gas which is sufficiently free of particulates that fluid fueled inflators will not require the filters which otherwise would be provided to remove particulates.

Figure 2:
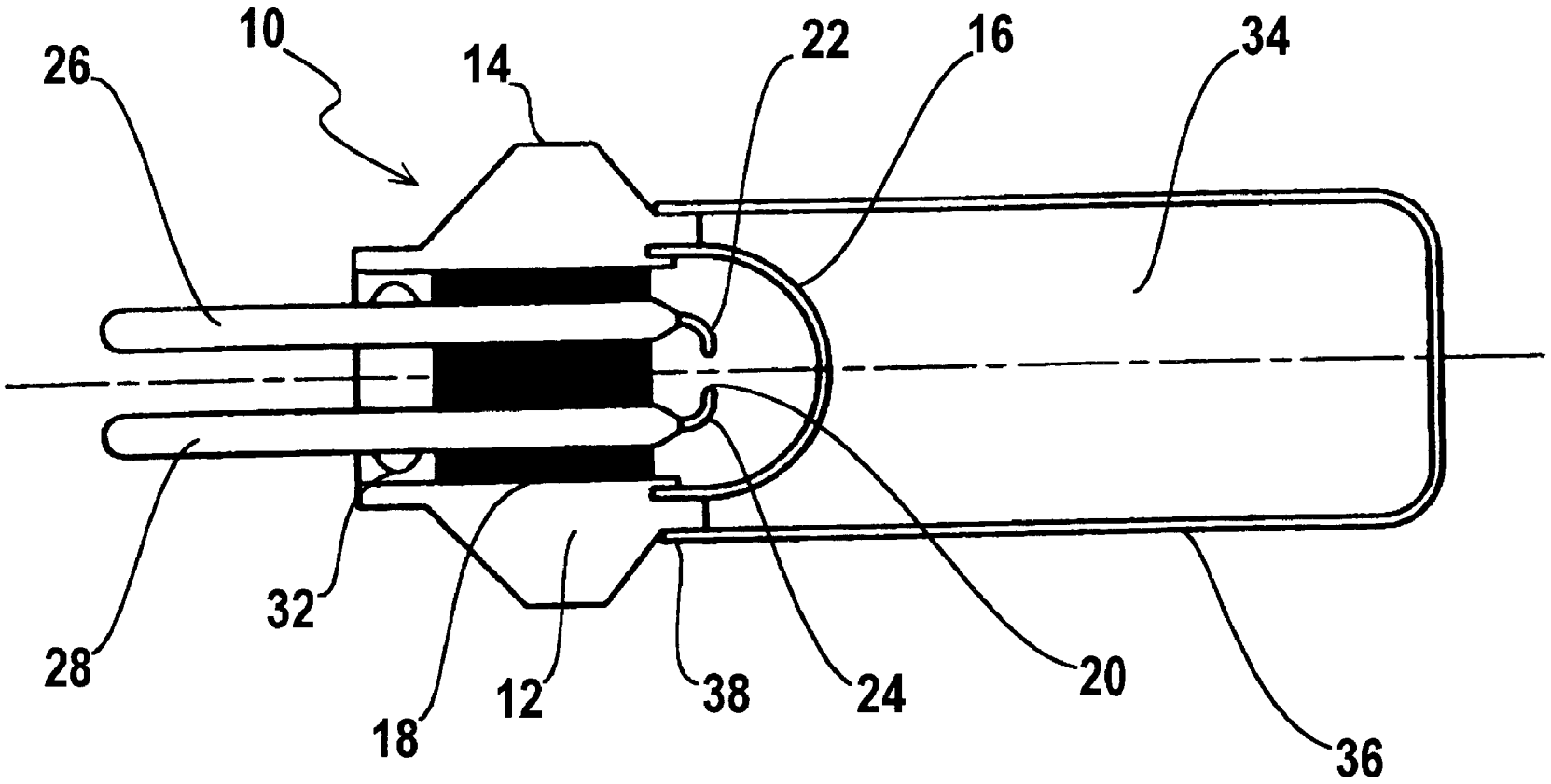
FIG. 2 illustrates a sub-assembly of an inflator wherein a non-pyrotechnic initiator is combined with a fluid fuel containment device.
Figure 3:
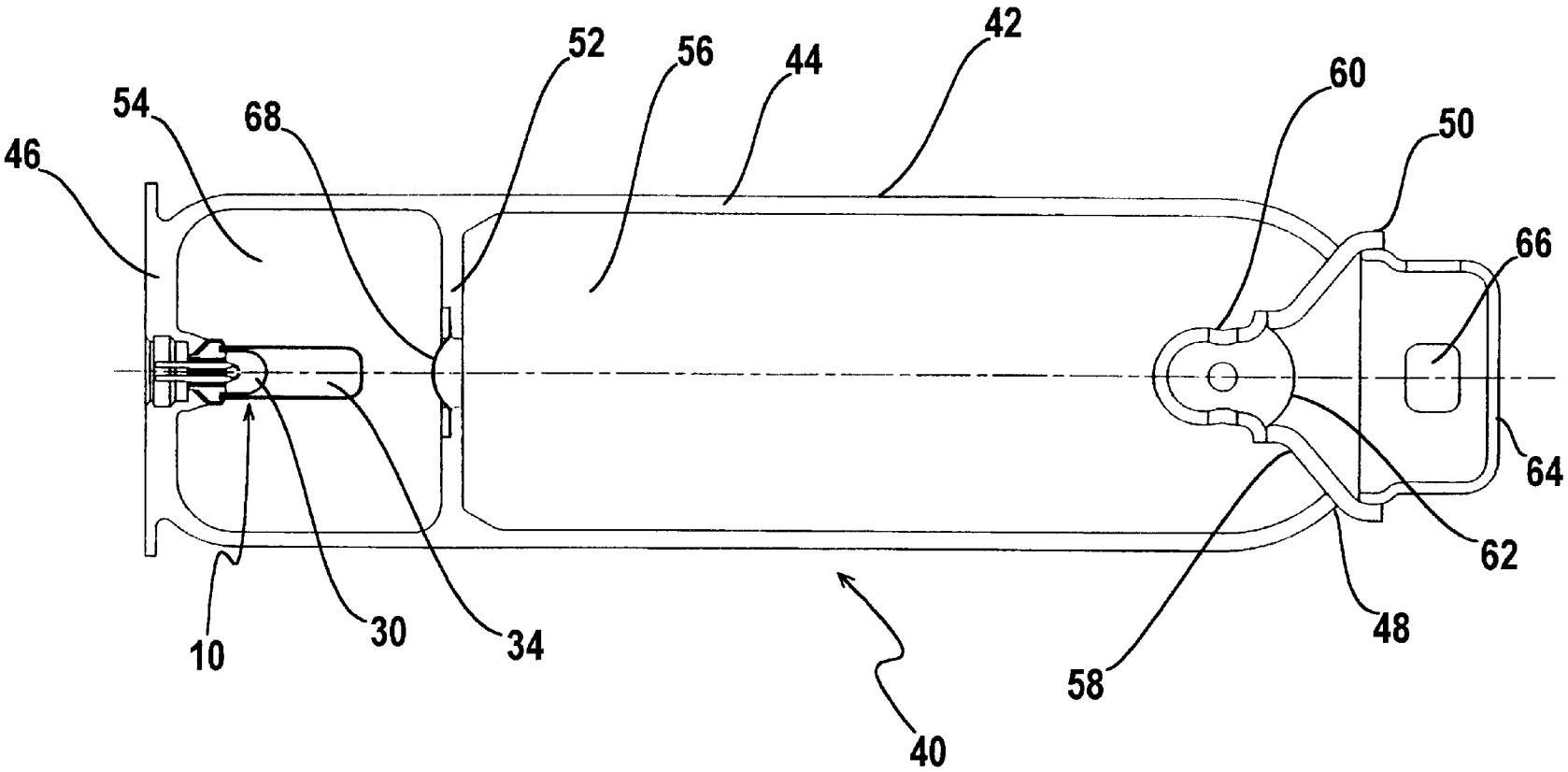
FIG. 3 illustrates an inflator suitable for use in an airbag passive restraint system which incorporates the sub-assembly illustrated in FIG. 2.

A sub-assembly for use in a fluid fuel inflator is illustrated in FIG. 2. The sub-assembly provides the initiator and the fluid fuel reservoir as a unit which can be assembled, as such, with the remaining components of the inflator. Since the initiator of the sub-assembly is essentially the same as the initiator depicted in FIG. 1, similar items are identified by the same item numbers as used in FIG. 1. The sub-assembly comprises a non-pyrotechnic initiator 10 corresponding to the initiator of FIG. 1, wherein at least a portion of the housing 12 also forms part of a further fluid fuel retaining chamber 34. The further chamber 34, in the embodiment of FIG. 3, is defined by the hemispherical cup 16, a portion of body 14 and an elongated generally cylindrical cup 36 which is sealed to body 14 by a weld, a crimp or a similar fluid tight attachment 38. The chamber 34 is designed to have sufficient volume and to have sufficient strength to contain the fluid fuel requirement of an associated fluid fuel inflator.

A fluid fuel inflator using a non-pyrotechnic initiator fluid fuel reservoir sub-assembly in accord with the present invention is illustrated in FIG. 3. The inflator 40 comprises a housing 42 having an elongated side wall 44 extending between a first end wall 46 and a second, or discharge, end 48 which is closed by a diffuser assembly 50. A bulkhead, or interior wall, 52 extends across the interior of the housing dividing it into two chambers, a combustion chamber 54 and an inert gas chamber 56. A sub-assembly comprising an initiator 10, as illustrated in FIG. 1, and a fluid fuel chamber 34, as illustrated in FIG. 2, is mounted through the first end wall 46. The diffuser assembly 50 comprises conical part 58 with a series of ports 60 and an opening means, such as a rupture disc 62, and cap part 64 with a further series of ports 66 arranged around its cylindrical side wall. The bulkhead 52 contains a further opening means such as a rupture disc 68. A fluid oxidant is provided in the combustion chamber 54, while a pressurized inert gas, such as nitrogen, argon, helium, zenon or krypton, is provided in the inert gas chamber 56.

Upon receipt of an electrical signal, or pulse, from an actuator, such as a crash sensor, through leads 26, 28, a spark is generated by the spark generator 20 causing the fluid combustible material in direct proximity therewith to ignite/combust. Combustion of the combustible material in the initiator creates sufficient heat and pressure to cause cap 16 to open, or rupture, whereby the heated products from the initiator mix with the fluid fuel stored in chamber 34. The fluid fuel is thereby heated and, with the products from the initiator, develops sufficient pressure to open or rupture the cylindrical cup 36, allowing the heated fuel containing mixture to be propelled into, mix with, and combust with the oxidizing gases contained in the combustion chamber 54. If the initiator products contain oxidizing components, they can combust a portion of the fluid fuel provided in chamber 34 to assist in developing sufficient pressure to open or rupture the cylindrical cup 34. When the preferred fluid, nitrous oxide ($N_2O$), is provided in chamber 30 of the initiator, molecular oxygen ($O_2$) is one of its ultimate dissociation/decomposition products and would be available for combustion with any oxidizable fuel provided in the fluid fuel retaining chamber 34. Either or both of the cap 16 and the cylindrical cup 34 may contain preselected rupture or opening areas provided by weakened portions of the wall of the cap and/or cup. Such weakened portions could comprise scored grooves in the surface of the wall or rupture discs installed in the wall. Combustion of the fuel containing mixture with the oxidizing gases in the combustion chamber 54 will result in an increased temperature, causing the pressure in the combustion chamber 54 to rise until the rupture disc 68 opens. Once the rupture disc 68 is opened, the heated combustion gases pass from the combustion chamber 54 to the inert gas chamber 56 wherein they mix with the pressurized inert gases stored in that chamber. Such mixing raises the temperature and pressure of the stored inert gas while cooling the combustion gases from the combustion chamber resulting in a pressurized product gas. The overall pressure in the inert gas chamber 56 initially increases until it exceeds the strength of the rupture disc 62 in the diffuser assembly, at which point such disc opens allowing the product gas to pass from the inflator through ports 60, the diffuser assembly 50 and exit ports 66. After the product gas passes the exit ports it is directed to the interior of an airbag cushion (not shown) to cause its rapid inflation.

It is also possible to provide an inflator having a single chamber by omitting the bulkhead 52 from the housing. If such an inflator is used with a sub-assembly comprising an initiator and a fuel reservoir, such as that shown in FIG. 2, and such reservoir contained a fluid fuel, the single chamber of this embodiment would contain an oxidant and would function as a combustion chamber. Alternatively, if the fluid fuel container of the FIG. 2 sub-assembly contained an exothermically dissociating fluid, such as $N_2O$, the single chamber of this embodiment could contain an inert gas.

While the inventive initiators described herein were developed for use with inflators for automotive airbag passive restraint systems, it should be apparent that they can be applied to any application which requires the rapid development of a large quantity of gas, such as for inflating life rafts, aircraft escape chutes, etc.

No unnecessary limitations on the invention should be assumed from the foregoing description. That description is intended to provide a full, clear, concise and exact explanation of the inventive inflator and how it is made and used. The scope of the invention is set forth in the following claims.

We claim:

1. An initiator and fuel supply assembly for use with an initiator for an airbag passive restraint system, comprising:

a first fluid retaining chamber, an electrically actuated igniter device selected from the group consisting of spark gap and resistive bridge elements and located in said first fluid retaining chamber, electrical leads operatively connected to said igniter device, a non-pyrotechnic oxidant-containing fluid combustible material stored within said first fluid retaining chamber in direct contact with said element of said igniter device, a second fluid retaining chamber adjacent to said first fluid retaining chamber, and a fluid fuel stored within said second fluid retaining chamber, whereby the application of an electrical signal to said leads causes said igniter device to develop sufficient energy to ignite said combustible material causing both of said first fluid retaining chamber and said second fluid retaining chamber to open dispersing said fluid fuel into the inflator.

2. The initiator and fuel supply assembly of claim 1, wherein:

at least a portion of the structure defining said first fluid retaining chamber also defines a portion of said second fluid retaining chamber, and said portion of the structure contains a rupturable segment, whereby said ignition of said combustible material causes said rupturable segment to open.

3. The initiator and fuel supply assembly of claim 1, wherein:

said first fluid retaining chamber is fabricated of materials which are non-frangible, whereby the ignition of said combustible material and opening of said first chamber do not produce a substantial number of solid particulates in the combustion products.

4. The initiator and fuel supply assembly of claim 1, wherein:

said non-pyrotechnic fluid combustible material comprises a material selected from the group consisting of liquid monopropellants, fluid materials which dissociate exothermically and mixtures of fluid fuels with fluid oxidizers.

5. An inflator for use with airbag passive restraint systems, comprising:

a first fluid retaining chamber, an electrically actuated igniter device selected from the group consisting of spark gap and resistive bridge elements and located in said first fluid retaining chamber, a non-pyrotechnic oxidant-containing fluid combustible material stored within said first fluid retaining chamber in direct contact with said element of said igniter device, a second fluid retaining chamber adjacent to said first fluid retaining chamber, a further fluid combustible material stored within said second fluid retaining chamber, a third fluid retaining chamber adjacent to said second fluid retaining chamber, and a compressed gas stored in said third fluid retaining chamber, whereby:

the application of an electrical signal to said igniter device will cause the ignition of said non-pyrotechnic oxidant-containing fluid combustible material causing both of said first fluid retaining chamber and said second fluid retaining chamber to open allowing said further fluid combustible material to combust and mix with said compressed gas resulting in a volume of gas which is suitable for use in said airbag passive restraint system.

6. The inflator of claim 5, wherein:

said compressed gas comprises a gas selected from the group consisting of oxygen and nitrous oxide.

7. The inflator of claim 5, wherein:

said compressed gas further comprises a gas selected from the group consisting of nitrogen, carbon dioxide, helium, argon, krypton and xenon.

8. The inflator of claim 5, wherein:

said third fluid retaining chamber contains a rupturable seal which is adapted to open when said further fluid combustible material is combusted and mixed with said compressed gas, thereby releasing a volume of heated gas for use in said airbag passive restraint system.

9. The inflator of claim 5, wherein:

said further fluid combustible material comprises a fuel selected from the group consisting of ethyl alcohol, isopropyl alcohol, propane, butane, pentane, hexane, heptane and octane.

10. The inflator of claim 5, wherein:

said further fluid combustible material comprises nitrous oxide.

11. The inflator of claim 5, wherein:

said non-pyrotechnic fluid combustible material comprises nitrous oxide.

12. The inflator of claim 5, wherein:

said non-pyrotechnic fluid combustible material comprises a mixture of a fluid fuel with a fluid oxidant.

13. The inflator of claim 12, wherein:

said fluid fuel comprises at least one of ethyl alcohol or propyl alcohol.

14. The inflator of claim 12, wherein:

said non-pyrotechnic fluid combustible material comprises butane and nitrous oxide.

15. The inflator of claim 5, wherein:

said non-pyrotechnic fluid combustible material is stored in said first fluid retaining chamber under conditions which cause it to auto-ignite at a temperature of 300° C. to 550° C.

16. The inflator of claim 5, wherein:

said first fluid retaining chamber is fabricated from rigid non-frangible materials.

17. An inflator for use with airbag passive restraint systems, comprising:

a first fluid retaining chamber, an electrically actuated igniter device located in said first fluid retaining chamber, a non-pyrotechnic fluid combustible material stored within said first fluid retaining chamber and adjacent said igniter device, a second fluid retaining chamber adjacent to said first fluid retaining chamber, a further fluid combustible material stored within said second fluid retaining chamber, a third fluid retaining chamber adjacent to said second fluid retaining chamber, a compressed gas stored in said third fluid retaining chamber, a fourth fluid retaining chamber adjacent to said third fluid retaining chamber, and a further compressed gas stored in said fourth fluid containing chamber, whereby:

the application of an electrical signal to said igniter device will cause the ignition of said non-pyrotechnic fluid combustible material causing both of said first fluid retaining chamber and said second fluid retaining chamber to open allowing said further fluid combustible material to combust and mix, said third fluid retaining chamber contains a rupturable seal which is adapted to open when said further fluid combustible material is combusted and mixed with said compressed gas, thereby releasing a volume of heated gas, said volume of heated gas released when said rupturable seal opens will mix with and heat said further compressed gas to develop an enhanced volume of gas suitable for use in said airbag passive restraint system.

18. The inflator of claim 17, wherein:

said further compressed gas comprises an inert gas selected from the group consisting of argon, nitrogen, helium, krypton or xenon.

* * * * *